US005975428A

United States Patent [19]

Potschin et al.

[11] Patent Number: 5,975,428

[45] Date of Patent: Nov. 2, 1999

[54] FUEL INJECTION DEVICE FOR INTERNAL COMBUSTION ENGINES

[75] Inventors: Roger Potschin, Brackenheim; Friedrich Boecking, Stuttgart, both of Germany

[73] Assignee: Robert Bosch GmbH, Stuttgart, Germany

[21] Appl. No.: 09/029,010

[22] PCT Filed: Jan. 9, 1997

[86] PCT No.: PCT/DE97/00019

§ 371 Date: Feb. 17, 1998

§ 102(e) Date: Feb. 17, 1998

[87] PCT Pub. No.: WO97/48900

PCT Pub. Date: Dec. 24, 1997

[30] Foreign Application Priority Data

Jun. 15, 1996 [DE] Germany ..... 196 24 001

[51] Int. Cl.[6] ..... F02M 47/02

[52] U.S. Cl. ..... 239/88; 239/90; 239/585

[58] Field of Search ..... 239/88–92, 95, 239/124, 533.3, 533.12, 584, 585; 251/129.01, 129.14

[56] References Cited

U.S. PATENT DOCUMENTS 4,527,737 7/1985 Deckard ..... 239/89

4,566,416 1/1986 Berchtold ..... 123/458

4,964,571 10/1990 Taue et al. ..... 239/88

5,042,718 8/1991 Bergmann et al. ..... 239/88

5,275,337 1/1994 Kolarik et al. ..... 239/91

FOREIGN PATENT DOCUMENTS 1320057 6/1973 United Kingdom ..... 239/89

*Primary Examiner*—Andres Kashnikow

*Assistant Examiner*—Lisa Ann Douglas

*Attorney, Agent, or Firm*—Edwin E. Greigg; Ronald E. Greigg

[57] ABSTRACT

A fuel injection device for internal combustion engines in which a fuel injection valve has a tappet which is actuated by an injection valve member and defines a control chamber that is supplied continuously with high fuel pressure via a throttle and can be relieved via a control valve and an outflow conduit. To that end, the control valve has a valve member, which is actuated by a piezoelectric element in such a way that the valve member is moved toward the control chamber when the outflow conduit opens. In the closing position, the valve member is urged in the closing direction by the pressure in the control chamber.

20 Claims, 5 Drawing Sheets

FUEL INJECTION DEVICE FOR INTERNAL COMBUSTION ENGINES

PRIOR ART

The invention is based on a fuel injection device for internal combustion engines. In a fuel injection device of this type, known from British Patent GB 1 320 057, the outflow conduit coming from the control chamber discharges into a collection chamber, which communicates with a relief chamber via a relief line leading onward. The valve seat for the valve member of the control valve is provided at the inlet of the outflow conduit into this collection chamber. As its drive mechanism, this valve member has a piezoelectric element and is embodied as a valve member with a conical sealing face. This valve performs the function of controlling the pressure in the control chamber, taking into account the fact that if a piezoelectric element is to function operationally reliably, it cannot be acted upon except by pressure. In this regard, the closing force transmitted by the valve seat and the resultant force, which is exerted on the valve member from the pressure relief via the cross section of the outflow conduit, act upon the piezoelectric element. Some of the work capacity of the piezoelectric element is then lost, because it has to furnish of the closing force.

Advantages of the Invention

The fuel injection device according to the invention, has the advantage that the closing force required for tightly closing the control valve need not be brought to bear by the piezoelectric element but instead is generated by the pressure in the control chamber. A high adjusting force to be brought to bear by the piezoelectric element is necessary only for opening the valve, and once again the piezoelectric element is acted upon by the adjusted pressure in the control chamber. As soon as the valve has opened, the force counteracting the adjusting motion or the opening of the control valve is rapidly diminished, so that in this case as well the piezoelectric element does not undergo any substantial stress. Thus in the embodiment of the invention the piezoelectric element that actuates the control valve can be substantially smaller, and the requisite energy can be kept slighter. In the closing position of the valve, the result is a self-sealing function, because of the fact that in this position, the high fuel pressure delivered via the inlet always prevails in the control chamber.

In an advantageous further feature, the space required for the adjusting motion of the valve member in the opening direction is reduced to the region of a recess, so that the diameter of the control piston can be kept small, which in turn has the advantage that higher speeds of the fuel injection valve member can be attained, since the volumetric flow to be forced in and out of the control chamber is less.

In another advantageous feature, two valve seats in line with one another are provided in the course of the outflow for relieving the pressure of the control chamber via the outflow conduit. Upon an adjusting motion of the valve member in the direction of the control chamber, the valve formed by the valve member and the first valve seat is opened, and as a consequence the valve formed by the valve member and the second valve seat is closed. When the valve member rests with its sealing face on the first valve seat, the pressure in the control chamber is built up in the sense of closing the fuel injection valve. If the injection valve is to move to the opening position, then upon an actuation of the piezoelectric element the valve member lifts up from the first valve seat. In this process, it can remain in an intermediate position, in which the flow cross section at both valve seats is opened. In this position, the injection valve member of the fuel injection valve can move to the opening position, so that a fuel injection takes place that is determined by the length of time that the valve member of the control valve remains in this position. Conversely, if the piezoelectric element is triggered such that it can execute its full actuation stroke, then after the cross section at the first valve seat opens the valve member of the control valve comes into contact with the second valve seat, so that in this position again the control chamber is blocked on the relief side. However, a brief relief of the control chamber takes place for the duration of the motion from the first valve seat to the second valve seat, during which a brief injection event is made possible. This injection event is utilized for a preinjection. For the ensuing required main injection, the valve member can then be put in the intermediate position between the two valve seats, and to terminate the main injection it can be returned to the first valve seat again, under the joint influence of the high pressure that builds up in the control chamber. With this embodiment, an especially advantageous additional possibility of controlling minimal preinjection quantities at minimal effort and expense is achieved.

In a further advantageous feature, the second valve seat is embodied on an elastically deformable intermediate part. This has the advantage that the requisite work capacity of the piezoelectric element, as a drive mechanism for the valve member of the control valve, can be kept even slighter. If the valve member of the control valve, after the cross section at the first valve seat is opened, comes into contact with the second valve seat, then a differential pressure is present at the elastically deformable intermediate part. On the side remote from the control chamber, pressure relief to the relief chamber is available, while the high pressure prevails when the cross section at the second valve seat in the control chamber is closed. Because of this force ratio, the intermediate part can now deform and move in the direction of the drive side of the valve member of the control valve. This reduces the stroke that the piezoelectric element must execute to open the cross section at the second valve seat, in order then to relieve the control chamber in order to furnish the main injection. If the valve member to that end lifts up from the second valve seat, then because the unilateral force exerted on the deformable intermediate part is rescinded, this intermediate part is returned to its normal position, thus bringing about fast opening of the relief cross section.

An especially advantageous embodiment comprises the pressure proof embodiment of the surroundings of the tappet by means of advantageous high-pressure carrying of fuel to the pressure chamber of the fuel injection valve in the form of a longitudinal conduit in the fuel injection valve. From there, the inflow conduit can advantageously be extended into the solid housing.

In particular, advantageous features of the sealing faces at the valve member of the control valve are provided.

DRAWINGS

In the drawing, seven exemplary embodiments of the invention are shown and will be described in detail in the ensuing description. FIG. 1 shows a schematic view of a fuel injection device with supply from a high-pressure reservoir and with a fuel injection valve of a known type, controlled by a control valve; FIG. 2 is a fragmentary section through the fuel injection valve according to the invention corresponding to detail A in FIG. 1 and showing the control chamber and a valve member of the control valve, the valve member being driven in a piezoelectric element not otherwise shown; FIG. 3 shows a second exemplary embodiment of the invention, having a control valve that has a first and a second valve seat and has a modified form of the course of the outflow conduit; FIG. 4 shows the injection valve stroke referred to the adjusting stroke of the control valve member; FIG. 5 shows a third exemplary embodiment in a modification of the exemplary embodiment of FIG. 3, having a second valve seat that is disposed on an elastically deformable intermediate part, shown in a first position of the valve member of the control valve on the first valve seat; FIG. 6 shows the control valve with the valve member, located on the second valve seat in the closing position, in a modified form, with an elastically deformable intermediate part provided as in FIG. 5 and with an exaggeratedly shown deflection of this intermediate part in response to the differential pressure prevailing at it; FIG. 7 is a graph of the courses of motion of the valve seat at the intermediate part and of the adjusting stroke of the valve member, associated with the course of motion of the injection valve member; FIG. 8 shows a fifth exemplary embodiment of the invention, with a modified version of the second valve seat and of the second sealing face, cooperating with it, on the valve member; FIG. 9 shows a sixth exemplary embodiment of the invention with a valve member embodied in multiple parts; and FIG. 10 shows a seventh exemplary embodiment with an advantageous embodiment of the valve housing and an advantageous disposition of the inflow conduit to the control chamber.

DESCRIPTION OF THE EXEMPLARY EMBODIMENTS

A fuel injection device, with which a wide variation in fuel injection at high injection pressures and at little effort and expense and in particular with very exactly controllable instants of injection and injection quantities is possible and realized by a so-called common rail system. Such a system furnishes a different kind of high-pressure fuel source from that provided by the usual high-pressure injection pump. However, the invention can be used both in this so-called common rail system and in a fuel injection pump. The common rail system is given preference.

Figure 1:
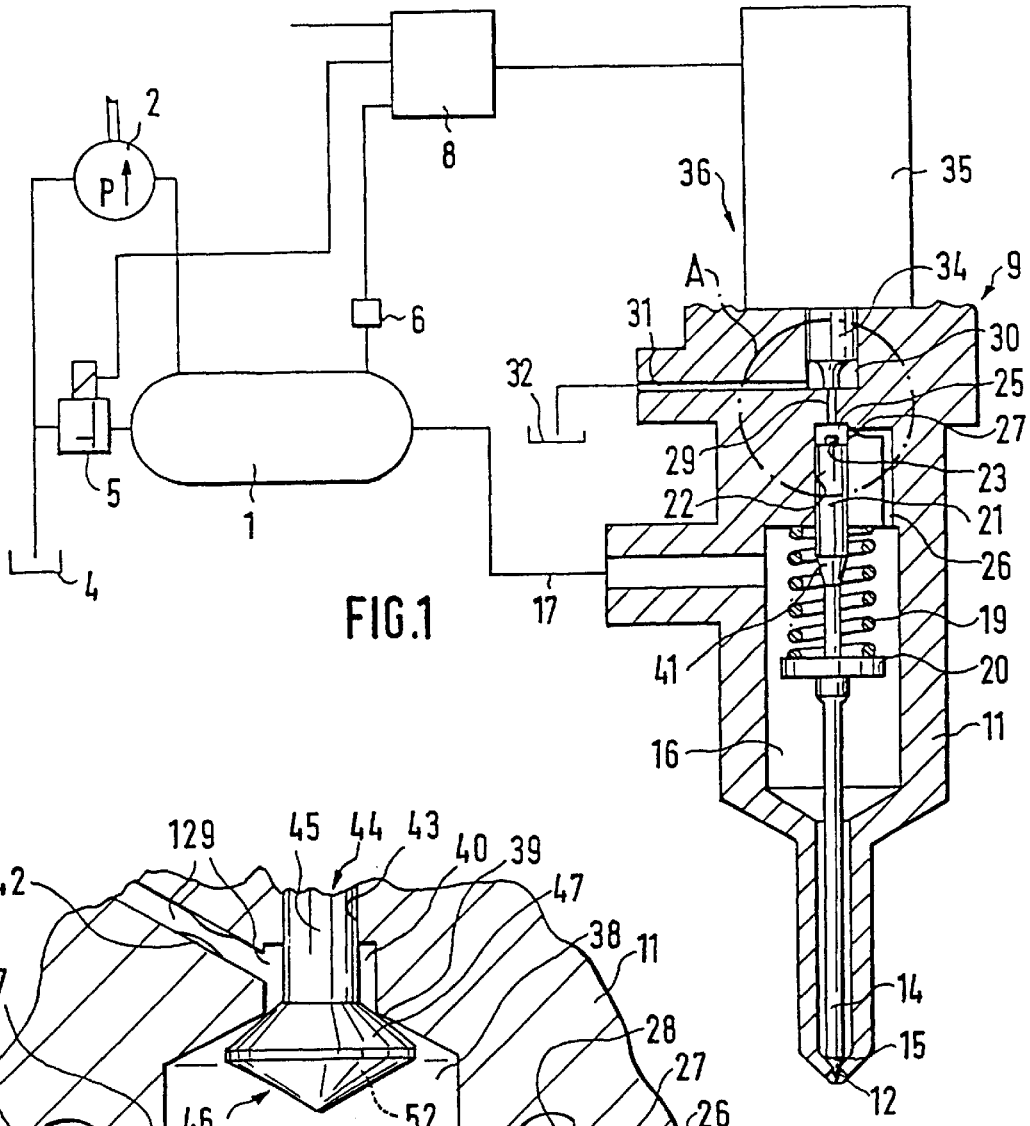

In FIG. 1, for a common rail pressure supply system in the form of a high-pressure fuel source, a high-pressure fuel reservoir 1 is provided, which is supplied with fuel by a high-pressure fuel feed pump 2 from a fuel tank 4. The pressure in the high-pressure fuel reservoir 1 is controlled by a pressure control valve 5 in conjunction with a pressure sensor 6 via an electric control unit 8. The electric control unit also controls a fuel injection valve 9.

In a known feature, the fuel injection valve 9 has a valve housing 11, which on its end intended for mounting on the engine has injection openings 12, whose outlet from the interior of the fuel injection valve is controlled by an injection valve member 14. In the example being described, this valve member is embodied as an elongated valve needle, which on one end has a sealing face 15 that cooperates with a valve seat located on the inside. The valve needle is located inside a pressure chamber 16, inside the valve housing, that communicates through a pressure line 17 with the high-pressure fuel reservoir 1. In an enlarged-diameter portion of this pressure chamber, a compression spring 19 is axially fastened between a valve plate 20 and the valve housing and urges the injection valve member 14 in the closing direction. A tappet 21 is provided coaxially with the compression spring and rests on one end on the valve plate 20 while on the other it dips into a guide bore 22, where with its face end 23 forms a movable wall, it encloses a control chamber 25 with the closed end of the guide bore. Discharging into this control chamber is an inflow conduit 26, in which there is a throttle 27 and which, originating at the pressure chamber 16, always furnishes fuel at high pressure to the control chamber 25 via the throttle 27. From the control chamber 25, an outflow conduit 29 leads coaxially with the tappet 21 away from the face end opposite the tappet; the outflow conduit discharges into a relief chamber 30 inside the valve housing 11, and this relief chamber leads via a relief line 31 extending onward to a capacious relief chamber 32, which for example may be the fuel tank 4.

In this known injection valve, the mouth of the outflow conduit 29 into the relief chamber 30 is controlled by a valve member 34 of a control valve 36, which is embodied as a seat valve; this valve member can be moved into the closing or opening position by a piezoelectric element 35.

The known fuel injection device functions as follows:

By means of the high-pressure fuel feed pump 2, preferably driven in synchronism with the engine, fuel is fed out of the fuel tank 4 into the high-pressure reservoir 1, whose pressure is set to a preferably constant value, via the pressure control valve 5 in conjunction with the pressure sensor 6. This value can also be changed as needed. The fuel available from this high-pressure fuel reservoir supplies a plurality of fuel injection valves of the type described. As long as the valve member 34 of the control valve 36 is in the closing position shown, then because of the high fuel pressure delivered via the pressure line 17, this high pressure is maintained in the control chamber 25 as well, and this pressure, in addition to the compression spring 19, now acts via the movable wall 23 upon the valve member 14 with a closing force, so that the injection valve member 14 is moved to the closing position and remains in this position. However, if the control valve 36 is opened, then the control chamber 25 can be relieved via the outflow conduit 29. Because of the decreasing pressure in the control chamber, the closing force of the compression spring 19 no longer suffices to keep the injection valve member 14 in the closing position counter to the high fuel pressure engaging a sealing face 41 of the valve member, and hence this valve member moves to the opening position. Conversely, if the valve member 34 of the control valve 36 closes in the outflow conduit 29 again, then the high fuel pressure immediately resumes in the control chamber 25 and then returns the injection valve member 14 to the closing position, and the fuel injection is thus terminated.

Figure 2:
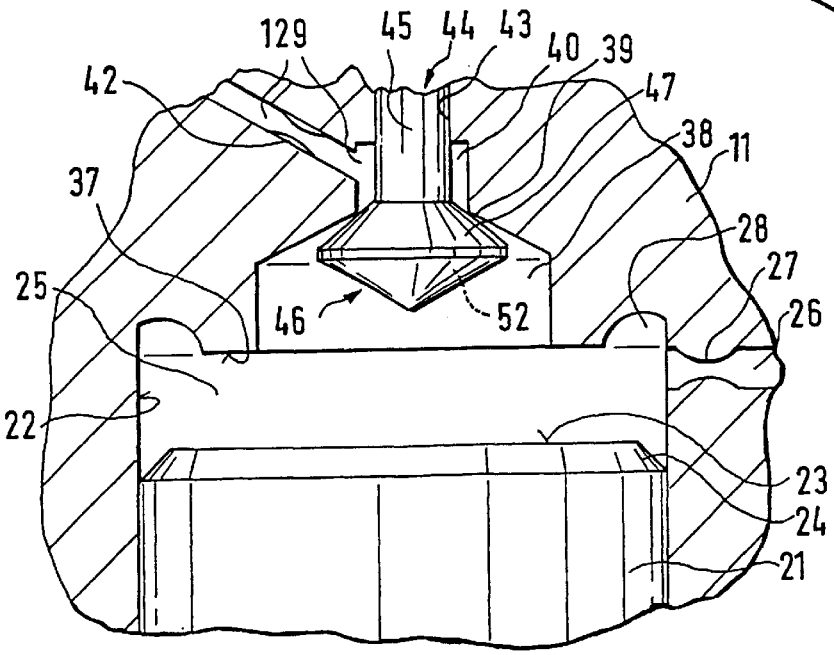

In order to improve the mode of operation of this known fuel injection device, the control valve has now been improved according to the invention. The details in which the invention is realized can be learned from the following drawing figures. FIG. 2 shows a detail of a fuel injection valve of the basic type shown in FIG. 1, and FIG. 2 corresponds to a detail A of this fuel injection valve. Once again, the face end 23 is embodied as a movable wall on the tappet 21 that encloses the control chamber 25. The inflow conduit 26 with the throttle 27 discharges into the control chamber, laterally of the circumferential wall of the guide bore 22, in such a way that the inflow is not closed by the tappet in any of its positions. On the face end 37 of the guide bore 22 opposite the face end 23 of the tappet, the outflow conduit 129 leads away, via a recess 38 in this face end 37. The transition from the circular-cylindrical recess 38 to the outflow conduit is made via a conical valve seat 39, which is initially adjoined by a cylindrical intermediate chamber 40 coaxial with the tappet 21, from which chamber the relief conduit then leads laterally away; a second throttle 42 is also disposed in the outflow conduit 129. Together with the first throttle 27, this determines the behavior of the pressure relief of the control chamber over time.

Now cooperating with the valve seat 39 is a valve member 44 of form modified compared with the valve member 34 of the control valve 36 of FIG. 1. This modified valve member has a valve tappet 45, which is guided in a bore 43 of the valve housing 11 and is coupled, on its other end not shown here, to the piezoelectric element 35. On its end protruding into the recess 38, this valve tappet has a head 46, on which a conical sealing face 47 pointing toward the valve seat 39 is provided. In the closing position, shown, of the control valve 36, which sealing face 47 rests on the valve seat 39, so that via the fuel flowing in through the inflow conduit 26 a high pressure builds up in the control chamber 25 and keeps the injection valve member 14 in the closing position. In this position, the head 46 is acted upon by the pressure prevailing in the control chamber 25, which also keeps the valve member in the closing position without actuation by the piezoelectric element. To open the control valve, the piezoelectric element is actuated, in such a way that the head 46 moves farther into the recess 38 and uncovers the flow cross section at the valve seat. In the initial phase this is effected first counter to the high pressure in the control chamber. As soon as the valve member has lifted slightly from the valve seat 39, pressure equilibrium is established at the valve member, so that for the further opening stroke relatively little opening work must be exerted at the piezoelectric element. The control chamber is relieved, and the injection valve member 14 opens. In the process, the tappet 21 as shown moves upward toward the face end 37. By means of a chamfer 24 on the face end 23 of the tappet 21 and an opposed annular recess 28 in the face end 37, a residual chamber is formed that acts as a hydraulic stop. In the region of this residual chamber, a residual surface area of the tappet 21 always remains exposed to the high fuel pressure delivered via the inflow conduit 26. Between the end face 23 and the end face 37 in the region between this residual chamber and the recess 38, a throttle gap remains that uncouples the relieved recess 38 from the residual chamber and serves the purpose of building up pressure in the recess 38 as well after the closure of the valve realized at the valve seat 39 and the valve member 44.

Figure 10:
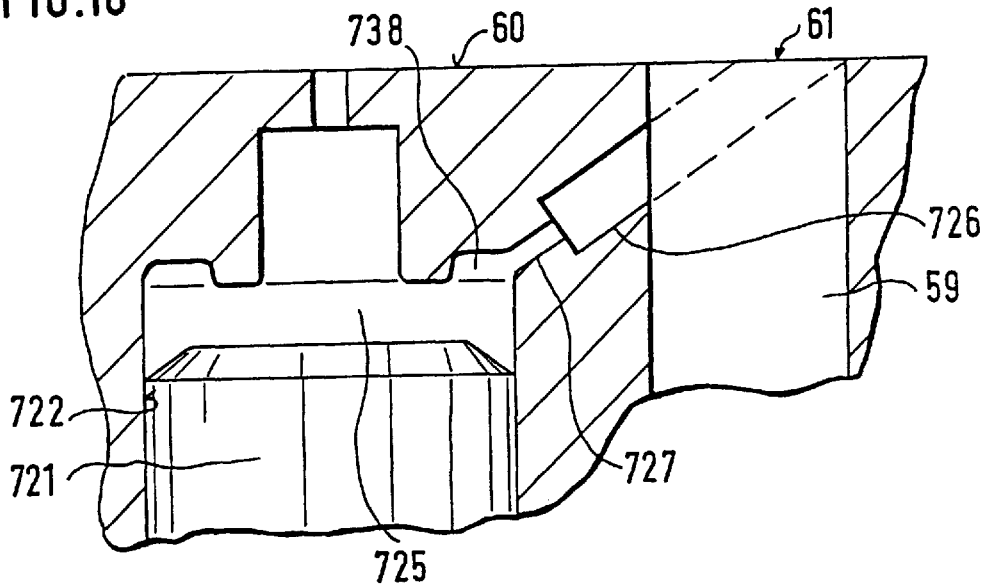

Introducing the inflow conduit 26 into the annular recess 28 that forms part of the residual chamber offers the substantial advantage that the inflow conduit 726 shows in FIG. 10 can be made obliquely to the axis of the tappet 721, beginning at a bore 59 that extends parallel to the axis of the injection valve and serves to supply pressure to the pressure chamber 16. If the injection valve housing is divided at the transition to the relief chamber 30 (FIG. 1), then advantageously the inflow conduit 726 can be drilled obliquely to the residual chamber 738, from the mouth 61 of the parallel bore 59, beginning at this dividing plane 60. This has the substantial advantage that around the control chamber 725, the solid injection valve housing is preserved, and no wall deformations caused by the high pressure prevailing in the high-pressure inlet can deleteriously affect the play in the fit between the guide bore 722 and the tappet 721. In particular, no annular chamber formed by a separate insert, from which the inflow conduit would have to deliver high-pressure fuel to the control chamber, as shown in European Patent Application EP A1 0 661 442, is necessary. In this reference, the guidance of the tappet is provided inside an insert that is surrounded by an annular chamber exposed to the high pressure and thus divides the control chamber from the annular chamber with a slight wall thickness.

With this feature, it is already possible at relatively little effort or expense with regard to the piezoelectric element 35 that actuates the control valve to perform reliable, fast control of injection events. Because the valve member presents high resistance to the piezoelectric element only at the moment of opening but subsequently, because of the pressure relief in the control chamber 25 these resistances become practically null, the piezoelectric element need merely be designed for this special loading situation.

Figure 3:
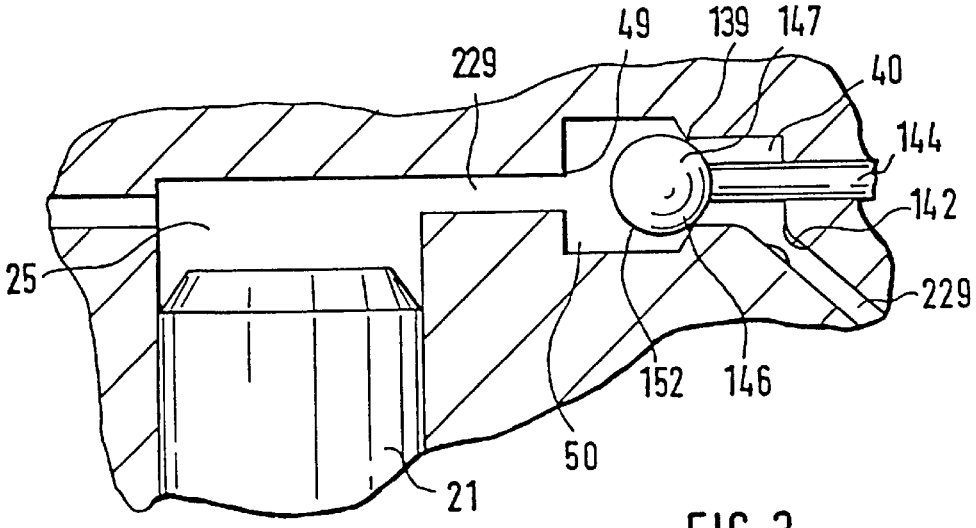

In a modification of FIG. 2, the outflow conduit 229 in FIG. 3 can also lead laterally away from the control chamber 25. FIG. 3 moreover shows a further advantageous feature of the invention, which is that the valve seat, here provided analogously to FIG. 2, is now a first valve seat 139, which is again bordered by the intermediate chamber 40, but from which then the outflow conduit 229 leads via a second throttle 142 to the relief chamber. Besides this first valve seat 139, a second valve seat 49 is now provided, coaxially with the first valve seat 139 and opposite it on the side toward the control chamber 25. To that end, in an intermediate region, the outflow conduit 229 has a valve chamber 50, into which the for instance spherically embodied head 146 of the valve member 144 can plunge. Instead of this spherical form, a form as shown in FIG. 2 is also entirely possible, with a conical sealing face 47 as the first sealing face and, shown as a possible alternative in FIG. 2 for use in FIG. 3 by a dashed reference line, a second, likewise conical sealing face 52 opposite the first.

In FIG. 3, with a conical head, the first sealing face 147 is embodied toward the side of the first valve seat 39, and opposite it a second sealing face 152 is realized in a continuation of the spherical form. This second sealing face, upon actuation of the valve member 144, is brought into contact with the second valve seat 49, and in this position the valve member 144, after an intervening opening of the outflow conduit 229, closes this conduit again. Over the duration of the stroke of the valve member 144 from its position, shown in FIG. 3, on the first valve seat 139 to the second valve seat 49, a relief of the control chamber 25 occurs such that the injection valve member can briefly open. If the valve member rests with its second sealing face 152 on the second valve seat 49 again, then the pressure in the control chamber 25 builds up again very rapidly, and the fuel injection valve closes. This embodiment has the very substantial advantage that in a single sequence and direction of motion upon actuation of the valve member 144 by the piezoelectric element 35, an opening and reclosure of the relief line with intermediate relief of the control chamber can be performed, which makes it possible to achieve very short relief times. This is very helpful in interrupting injection between a preinjection and an ensuing main injection. While for such a procedure in all the known versions a first back-and-forth motion of the valve member was required to create a preinjection, and a second back-and-forth motion of the valve member was required to determine the main injection, it is now possible by means of a single back-and-forth motion of the valve member to control both the preinjection and the main injection by injection interruption.

Figure 4:
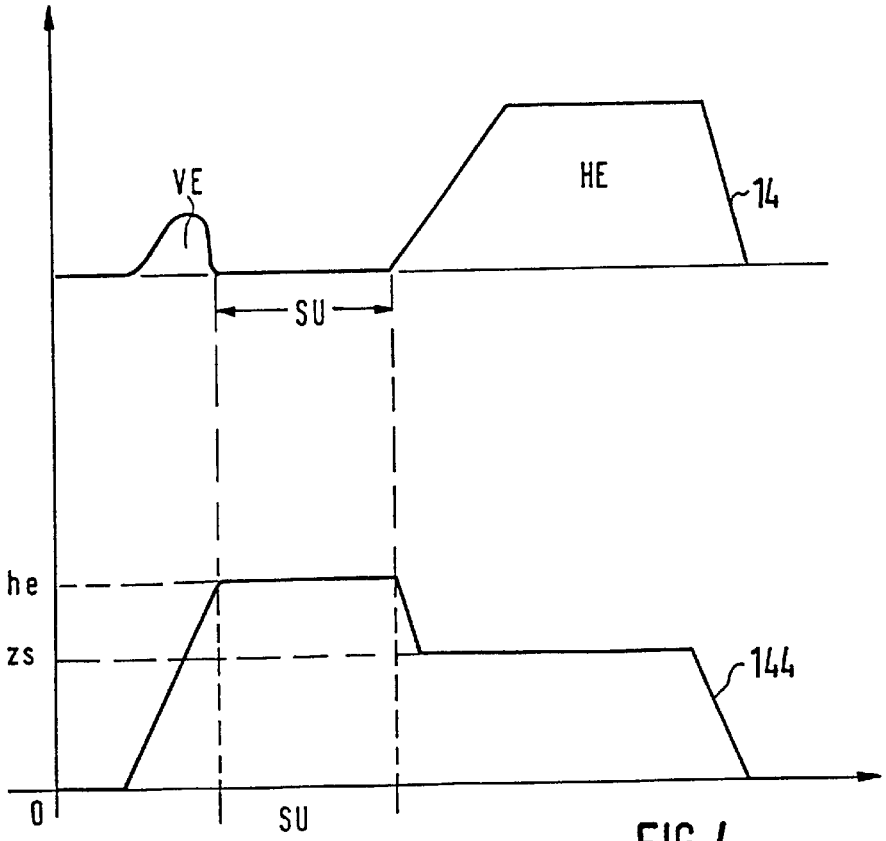

FIG. 4 to that end shows the stroke course of the injection valve member 14 and associated with it the stroke course of the valve member 144 of the control valve over time. In the upper portion of the graph the brief opening of the injection valve for performing the preinjection VE can be seen and then an injection interruption SU, followed by the opening of the injection valve for the main injection HE. In the lower portion of the graph it can be seen that from the starting position, where the stroke length is 0, the valve member 144 executes a stroke over which the preinjection occurs. At the stroke length he, this preinjection is ended, and the greatest deflection of the valve member 144 is also achieved. After remaining in this terminal position for the period SU, the return of the valve member 144 to an intermediate position ZS takes place, in which the cross sections at the two valve seats 139 and 49 are opened for the execution of the main injection HE, and this is followed by the final return to the first valve seat 139. In this version, the valve seats 139 and 49 are preferably coaxially in line with one another and are coaxial to the valve tappet of the valve member 144. In this way, one seat valve on each of the two valve seats is realized.

To reduce the demands made of the piezoelectric element for executing the adjusting motion of the valve member, in a further refinement of the exemplary embodiment of FIG. 3 the second valve seat is disposed as a valve seat 149 on an elastically deformable intermediate part 55. This part takes the form of a disk, for instance, which is preferably of metal and is tightly fastened between two halves of the valve housing 11. Coaxially to the tappet 21 or to the valve member 244, it has a through bore 56, that connects the valve chamber 150 with the control chamber 125.

Figure 5:
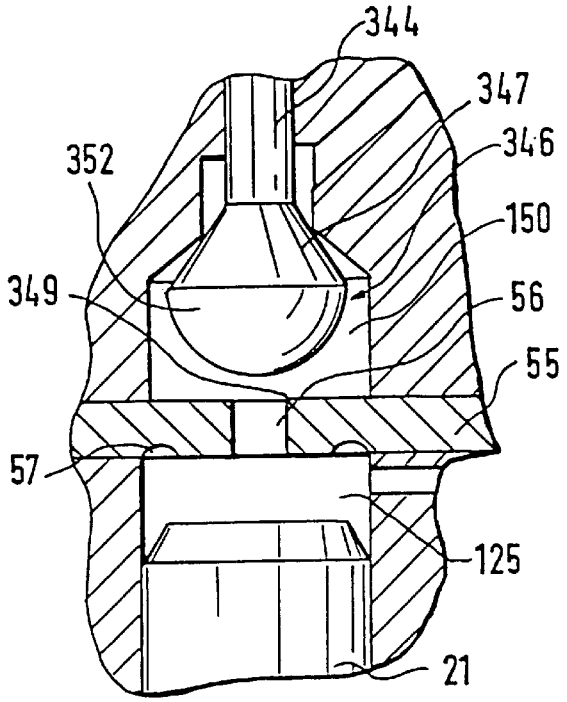
Figure 6:
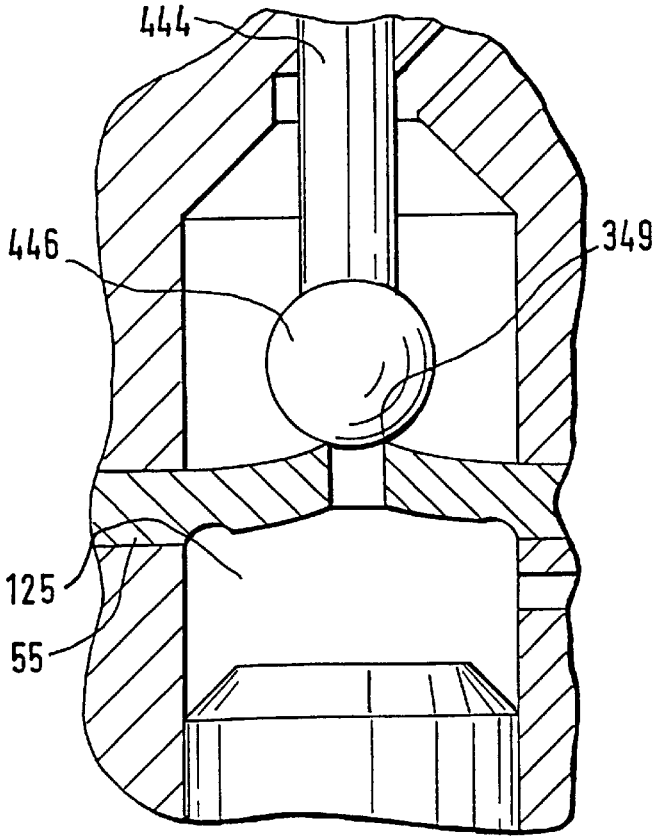
Figure 7:
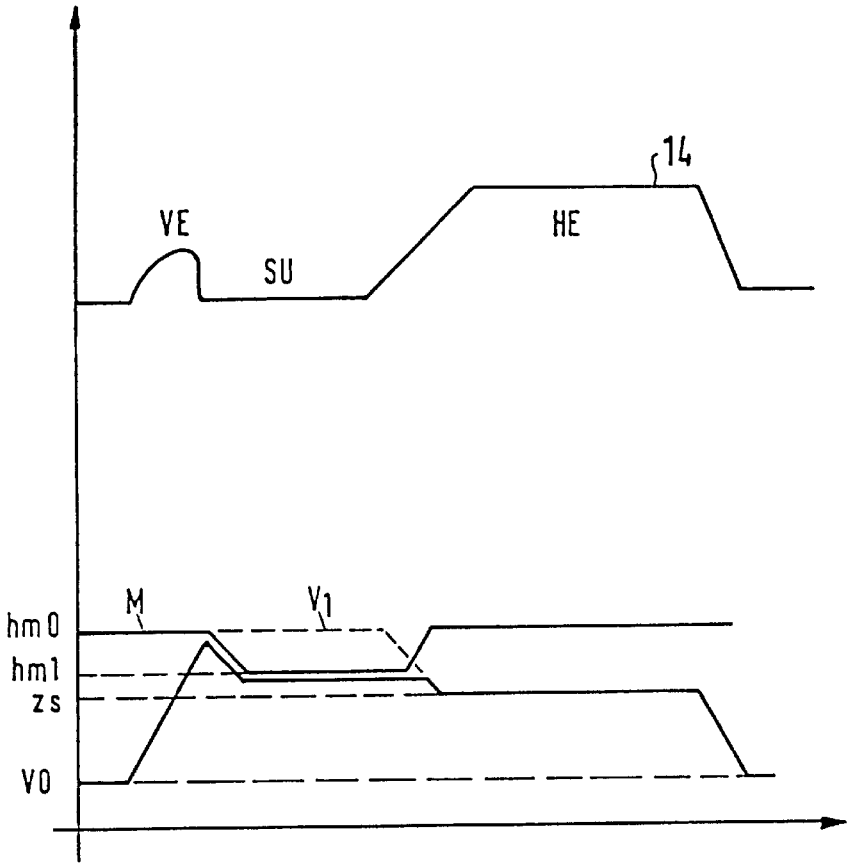

The entrance of the through bore 56 into the valve chamber 150 is embodied as a second valve seat 349, at which the second sealing face 352 of the valve member 344 comes tightly to rest in its maximally deflected position. The head 346 of the valve member 344 has a conical face as its first sealing face 347, and a spherical face as its second sealing face 352, in a modification of the exemplary embodiment of FIG. 3. However, a configuration of the head 46 as in FIG. 2 could also be used here. On the side toward the control chamber 125, the elastically deformable intermediate part has an annular recess 57, which is concentric with the through bore 56 and with which it is attained that the elastically deformable intermediate part can be more easily deflected, beginning at this annular recess 57, in particular upward toward the valve member 344. However, this property can also be attained by other kinds of reduction of the thickness of the intermediate part. In FIG. 6 this situation of the deflection of the intermediate part is shown, but there in terms of a valve having a head 446 of the valve member 444 that is spherical as in FIG. 3. If the head 446 comes into contact, by its second sealing face, with the second valve seat 349, then the high pressure prevailing in the high-pressure fuel feed pump can build up in the control chamber 25. If, in the position of the valve member 344 shown in FIG. 5, the valve chamber 150 was exposed to the same pressure as the control chamber 125, in the position of FIG. 6 now different pressures prevail, such that the elastically deformable intermediate part 55 is now deformed toward the valve member 444. This event is illustrated in FIG. 7. In graph portions associated with one another and located one above the other, the reciprocating motion of the injection valve member 14 is shown at the top, again having the region of the preinjection VE, the injection interruption SU, and the main injection HE. In the lower part of the graph, curve M represents the motion of the elastic intermediate part. At an outset position hmO, referred to the adjusting path of the valve member 444, the intermediate part with the second valve seat 349 is moved into a position hml. This begins at the end of the reciprocating motion of the valve member 440, when the valve member, beginning at the outset position V0, assumes the position hm0 in contact with the intermediate part. Once this position is reached, the valve member together with the second valve seat 349 of the intermediate part is brought, under the influence of the now-arising differential pressure, to the position hm1 and remains there as long as the valve member 444 is in contact with the second valve seat 349. After that, once the valve member 444 has lifted away from the second valve seat 349 again, it returns to its outset position hm0, and the valve member 444, as in the graph of FIG. 4, moves to an intermediate position ZS, in which the control chamber 125 is relieved and the main injection is completed. After that, the valve member returns to its terminal position V0. In the region in which the diaphragm deflects in the direction of the stroke hm1, the valve member can also be deflected backward, so that its stroke, from the original terminal position hm0, returns to a common terminal position hm1. The stroke to be executed by the valve member 444 afterward for complete opening is thus reduced compared with the version of the curve v1, shown in dashed lines, that would result without elastic deflection of the intermediate part. Since immediately after the second valve seat 349 lifts away from its seat both parts, that is, the valve member 444 and the elastically deformable intermediate part 55, execute a stroke in the opening direction, the result here is a very fast relief of the control chamber 125 for the execution of the main injection. The demands made regarding the maximum stroke length of the piezoelectric element are thus less, since the actual closing force to the second valve seat 349 is established together with the deformation of the elastically deformable intermediate part. This is very substantially advantageous, since the size of a piezoelectric drive mechanism and the energy furnished by the purpose increase substantially with the length of the required adjusting stroke. In the way described here, the required stroke length can be reduced for the same performance of the control valve.

Figure 8:
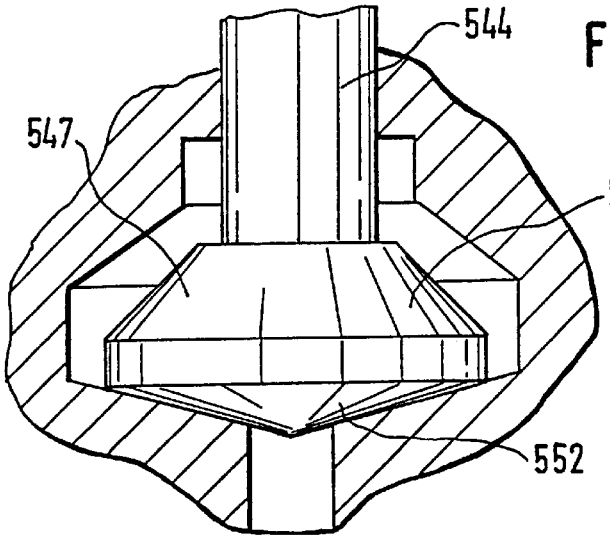

In the above description, various embodiments of the valve member have been shown. FIG. 8 also shows a variant with a head 546 of the valve member 544, which has one conical sealing face 547 and 552 as its first and second sealing face, respectively. The valve seats are embodied accordingly. In the final analysis, it is also possible instead of a conical second sealing face 552 to provide a flat-seat sealing face, with a correspondingly embodied second valve seat.

Figure 9:
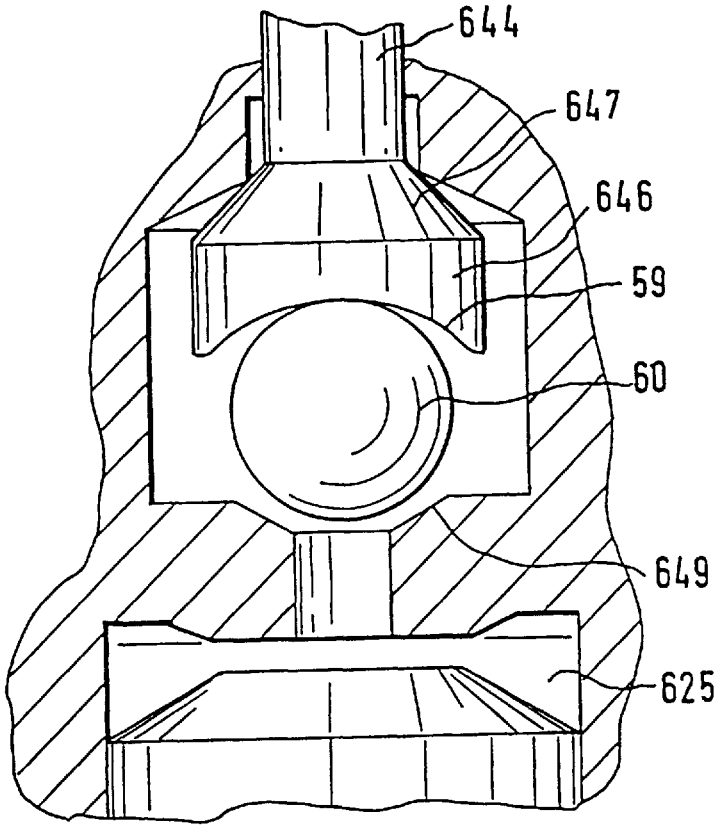

In a further feature in accordance with a sixth exemplary embodiment, the valve member 644 of FIG. 9 can be embodied in two parts, in such a way that it has a head 646, which has the first sealing face 647 and on the side remote from this sealing face a guide face 59, on which a second valve member 60 hydraulically coupled with the valve member 644 is guided. This second valve member is embodied as a ball in this example and cooperates with a spherical but preferably a conical second valve seat 649. In the position shown for the valve member 644 on the first valve seat 639, the ball 60 is held in contact with the valve member 64 by the pressure in the control chamber 625. Upon actuation, the ball is guided into contact with the second valve seat 649. With such a ball, which is a standard part, a tight fit with the valve seat can be achieved favorably.

The foregoing relates to preferred exemplary embodiments of the invention, it being understood that other variants and embodiments thereof are possible within the spirit and scope of the invention, the latter being defined by the appended claims.

We claim:

1. A fuel injection device for internal combustion engines, having a high-pressure fuel source (1) which supplies a fuel injection valve (9) with fuel, the fuel injection valve having an injection valve member (14) for controlling injection openings (12), a control chamber (25) which is defined by a movable wall (23) connected at least indirectly to the injection valve member (14), an inflow conduit (26), dimensioned by means of a throttle (27) which throttles fuel from the high-pressure fuel source (1), an outflow conduit (29) defined by a maximal outflow cross section to a relief chamber (30), at said outflow conduit, a valve seat (39) is formed that is controlled by a sealing face (47) of a valve member (44, 46) of a control valve (36) that is actuated by a piezoelectric element (35), the valve seat (39) is disposed pointing toward the control chamber (25) on the outflow conduit (129), and the piezoelectric element (35) lifts the valve member (44, 46) from the valve seat (39), counter to a pressure prevailing in the control chamber (25), in order to open the outflow conduit (129) toward the control chamber (25), and the valve member (44, 46) is urged in a closing direction by the pressure in the control chamber (25).

2. A fuel injection device in accordance with claim 1, in which the outflow conduit (129), on the face end (37) opposite the movable wall of the control chamber (25), discharges into the control chamber (25), and a recess (38) that receives the valve member (44, 46) in the open position thereof is disposed between the movable wall (23) and the face end (37).

3. A fuel injection device in accordance with claim 1, in which the valve seat on the outflow conduit is a first valve seat (139), and on the control chamber side of this first valve seat a second valve seat (49) is provided, which defines the outflow cross section of the outflow conduit (229) and is closed by an additional second sealing face (152), said sealing face is moved by the valve member (144, 146) under the influence of the actuation by the piezoelectric element, after the valve member (144, 146) has lifted from the first valve seat (139).

4. A fuel injection device in accordance with claim 3, in the spacing of the first valve seat (139) from the second valve seat (49) is dimensioned such that in an intermediate position of the valve member (144, 146), the outflow cross sections at both valve seats are opened.

5. A fuel injection device in accordance with claim 4, in which the valve seats (139, 49) are disposed coaxially to one another.

6. A fuel injection device in accordance with claim 5, in which the valve member (44, 144, 344, 44, 544, 644) has a head (46, 146, 346, 446, 546, 646) that carries at least one of the sealing faces (47, 52, 152, 147, 347, 352, 547, 552, 647), which head is disposed at an end of a tappet (45) that protrudes through the cross section of the outflow conduit bounded by the first valve seat (39, 139) and that between the tappet and the first valve seat defines the largest outflow cross section.

7. A fuel injection device in accordance with claim 6, in which the second sealing face (152) and the second valve seat (49) together form a seat valve, and the valve member (144, 146), when the seat valve is closed, is urged in the opening direction by the pressure in the control chamber (25).

8. A fuel injection device in accordance with claim 3, in which the second valve seat (349) together with a cross section leading onward to the control chamber (25) is embodied on an elastically deformable intermediate part (55), in a region of the second valve seat (349), and said elastically deformable intermediate part is fastened by its edges firmly between parts of the housing (11) of the fuel injection valve.

9. A fuel injection device in accordance with claim 8, in which the intermediate part (55) is embodied as a diaphragm.

10. A fuel injection device in accordance with claim 9, in which the diaphragm is a metal diaphragm, whose deformability is increased by regions of reduced diaphragm thickness, by means of annular recesses (57) located concentrically to the second valve seat.

11. A fuel injection device in accordance with claim 1, in which a maximum outflow cross section is formed by a throttle (42).

12. A fuel injection device in accordance with claim 3 in which the first valve seat is embodied as a conical valve seat (39, 139).

13. A fuel injection device in accordance with claim 12, in which the second valve seat is embodied as a ball seat.

14. A fuel injection device in accordance with claim 12, in which the second valve seat (552, 649) is embodied as a conical seat.

15. A fuel injection device in accordance with claim 12, in which the second valve seat is embodied as a flat seat.

16. A fuel injection device in accordance with claim 12, in which the second sealing face is embodied on a part (60) actuated by the valve member, which part comes to rest on the valve member (644, 646) in response to the pressure in the control chamber (25).

17. A fuel injection device in accordance with claim 16, in which the second sealing face is embodied on a ball (60) that is guided on a guide face (59) of the valve member (644, 646).

18. A fuel injection device in accordance with claim 6, in which the tappet (45) is guided in a bore (43) extending coaxially to the valve seats, between said bore and the first valve seat a chamber (40) is defined by the outflow conduit (129) which leads to the relief chamber (30, 32, 4).

19. A fuel injection device in accordance with claim 2, in which the valve seat on the outflow conduit is a first valve seat (139), and on the control chamber side of this first valve seat a second valve seat (49) is provided, which defines the outflow cross section of the outflow conduit (229) and is closed by an additional second sealing face (152), said sealing face is moved by the valve member (144, 146) under the influence of the actuation by the piezoelectric element, after the valve member (144, 146) has lifted from the first valve seat (139).

20. A fuel injection device for internal combustion engines, comprising a high-pressure fuel source (1), a fuel injection valve (9) which is supplied with fuel, the fuel injection valve having an injection valve member for controlling injection openings (12) and having a control chamber (25) which is defined by a movable wall (23), said movable wall is connected at least indirectly to the injection valve member (14) and which has an inflow conduit (726), dimensioned by means of a throttle which throttles fuel from a high-pressure source, an outflow conduit (29), connected with a relief chamber (30), a valve seat (39) is formed at said outflow conduit, fuel flow is controlled by a sealing face (47) of a valve member (44, 46) of a control valve (36) that is actuated by a piezoelectric element (35), the inflow conduit is supplied with fuel at high pressure from a pressure conduit (59) that extends longitudinally in the fuel injection valve, and the injection valve body is embodied in multiple parts, with a dividing plane (60) into which the pressure conduit discharges and from which the inflow conduit (726) is drilled through a mouth (61) of said pressure conduit into the dividing plane, and in an uppermost position of the movable wall (721), an annular residual chamber (738) remains between the face end of the bore (722) that receives the movable wall and the movable wall itself, and the inflow conduit (726) discharges into said residual chamber.

* * * * *